US007473179B2

(12) United States Patent
Xidos et al.

(10) Patent No.: US 7,473,179 B2
(45) Date of Patent: Jan. 6, 2009

(54) RETRO-FIT RESPONSIBLE GAMING SYSTEM

(75) Inventors: John Xidos, Sydney River (CA); Robert MacKenzie, Sydney (CA)

(73) Assignee: Techlink International Entertainment Ltd. (CA)

( * ) Notice: Subject to any disclaimer, the term of this patent is extended or adjusted under 35 U.S.C. 154(b) by 468 days.

(21) Appl. No.: 10/871,648

(22) Filed: Jun. 18, 2004

(65) Prior Publication Data

US 2005/0064938 A1 Mar. 24, 2005

Related U.S. Application Data

(63) Continuation-in-part of application No. 10/327,402, filed on Dec. 20, 2002.

(51) Int. Cl.
*A63F 9/24* (2006.01)

(52) U.S. Cl. ..... 463/29

(58) Field of Classification Search ..... None
See application file for complete search history.

(56) References Cited

U.S. PATENT DOCUMENTS 5,768,382 A * 6/1998 Schneier et al. ..... 380/251
5,910,048 A 6/1999 Feinberg
6,508,709 B1 * 1/2003 Karmarkar ..... 463/42
6,629,890 B2 * 10/2003 Johnson ..... 463/25
2002/0006214 A1 1/2002 Karlsson

FOREIGN PATENT DOCUMENTS

| | | |
|---|---|---|
| WO | WO-01/40982 | 6/2001 |
| WO | WO-01/63439 | 8/2001 |
| WO | WO-01/91038 | 11/2001 |
| WO | WO-03/042830 | 5/2003 |

OTHER PUBLICATIONS

Sommermeyer, Katrin , "PCT Search Report", Jul. 29, 204.

* cited by examiner

*Primary Examiner*—Robert E. Pezzuto
*Assistant Examiner*—Omkar Deodhar
(74) *Attorney, Agent, or Firm*—Russo & Duckworth, LLP

(57) ABSTRACT

The present invention relates generally to gaming systems. More particularly, the present invention relates to an electronic gaming system that enables an existing gaming system to be retro-fit to enable responsible gaming functionality to be added to the existing gaming system.

18 Claims, 8 Drawing Sheets

RETRO-FIT RESPONSIBLE GAMING SYSTEM

REFERENCE TO RELATED APPLICATIONS

This application is a continuation-in-part of U.S. application Ser. No. 10/327,402 filed Dec. 20, 2002, to which priority is claimed, which is incorporated herein by reference.

FIELD OF THE INVENTION

The present invention relates generally to gaming systems. More particularly, the present invention relates to an electronic gaming system that enables an existing gaming system to be retro-fit to enable responsible gaming functionality to be added to the existing gaming system.

BACKGROUND OF THE INVENTION

Electronic gaming systems (EGSs) are well known. Video lottery terminals and the like (VLTs), slot machines and other gaming devices are widely distributed in many jurisdictions and are located in many different establishments. The operation of EGSs is regulated, with government jurisdictions controlling and monitoring the deployment and operation of EGSs within a particular jurisdiction. Government controls are generally required to ensure that the operation of the EGS machines is in accordance with jurisdictional law and, more specifically, to ensure that revenues derived from the EGS are properly tracked and that the machines and their software cannot or have not been tampered with.

There is often a social cost associated with gaming in general. While the majority of gamblers using EGSs or casinos use gambling strictly as a casual form of entertainment and can afford the time spent gambling and monetary gambling losses, there are a significant number of gamblers that develop addictive or otherwise problematic behavior from excessive time spent gambling and/or gambling losses. Excessive time spent gambling and excessive gambling losses over both short and long term time frames may directly or indirectly lead to many different social problems. Gambling losses may be realized during short term gambling stints or progressively over a longer period of time.

As a result, there are various pressures to minimize the number of problem gamblers and the negative social effects that problem gamblers may cause. In the past, casinos and bar establishments having gaming and gaming machines expend considerable resources monitoring and controlling individuals that may be considered problem gamblers. These efforts generally focus on those individuals who display behavior that may be disruptive to other gambling patrons. Thus, while certain individuals can become aware to personnel at individual establishments and be excluded from that establishment, this monitoring activity is highly subjective and may only be effective for certain types of physical behavior and only after the problem has manifested itself.

For some individuals, problem gambling behavior does not manifest itself in any outwardly detectable manner at the establishment. For these individuals, problem behavior may be directly related to the time-spent gambling or to the amount of money spent during gaming. For these individuals, problem behavior may manifest itself indirectly and away from the establishment.

Other problems that may exist include underage play where minors access EGSs without being properly screened by the establishment.

As a result, there has been a need for a system that enables an effective compromise between the revenue interests of the jurisdiction and which also enables some gamblers to be excluded from gaming in an effective, yet unobtrusive manner.

U.S. patent application Ser. No. 10/327,402 and PCT application CA2003/001983, the contents of which are incorporated herein by reference, describe a responsible gaming system including EGSs that enable individual player identification, with the potential for certain restrictions to be imposed upon individual gamblers. Time limits and money losses over both short and longer time frames can be set by the gambler, by the establishment, or by regulators to limit the daily, weekly, or monthly amounts of time and/or money spent during EGS usage.

It is recognized that implementing such responsible gaming systems through the purchase of specialized EGSs requires the establishment to incur substantial expense in replacing existing EGS units, many of which would otherwise remain operational for several years. Many such establishments may believe that the replacement cost would outweigh the potential societal benefit in replacing existing EGS units with responsible gaming devices, thereby creating a barrier to the adoption of the responsible gaming systems.

It is, therefore, desirable to provide a device or system to enable the conversion of existing VLT units to responsible gaming systems.

SUMMARY OF THE INVENTION

In accordance with the invention, there is provided a responsible gaming system for allowing or denying player access to a local gaming device on a gaming network comprising:

- a central management module for receiving, storing, and processing identity data relating to individual players enrolled with the system and gaming data relating to gaming activities of the individual players using the system; and,
- a player management device for operative connection to a local gaming device and the central management module, the player management device for receiving identity data from a player, communicating player identity and gaming data to the central management module and for controlling access to the local gaming device in response to approval by the central management module.

In a further embodiment, the central management module provides instructions to a player management device to enable activation or cause de-activation of a local gaming device in accordance with pre-determined player exclusion criteria. In a further embodiment, the pre-determined exclusion criteria include any one of or a combination of time spent gaming, money lost over a period of time, money won over a period of time, total hours of access over a period of time, time of day hours of access, and account deposit limits over a period of time.

In a still further embodiment, the player management device includes a communication port for operative connection to a local gaming device through a flow-through communication port.

In another embodiment, the player management device includes an input system enabling a player to enter pre-determined exclusion criteria into the system.

Further, the system may include at least one enrolment device operatively connected to the central management module wherein the enrolment device includes an identity input system for inputing player identity information to the system for establishing a player account. The enrolment device may include an enrolment input system enabling a player to enter pre-determined exclusion criteria into the system.

In another embodiment, the identity input system includes a biometric input system.

Further still, in one embodiment, the enrolment device may download player identity information to a player token selected from any one of or a combination of a magnetic swipe card, smart card, IC card, ibutton, proximity card, RF card, flash card, USB hard drive, key fob, memory stick, PCMCIA card, EEPROM, RAM data keys and optical storage devices including CD-R/RW and DVD-R/RW.

In yet another embodiment, the player management device includes a token reading device for operatively receiving player identity information from a player token.

Further still, the player management device may include a biometric capture device for receiving biometric information from a player.

In another embodiment, the player management device reports biometric information to the central management module and the central management module evaluates the uniqueness of the biometric information within the system.

In yet another embodiment, the player management device is operatively connected to an establishment computer and the input system enables a player to access other establishment services and/or a player's account fund information and exclusion limits are stored on a player token.

In another embodiment, the invention provides a player management console (PMC) for controlling player access to an electronic gaming device, the PMC comprising:

a first communication port for operative attachment to an electronic gaming device;

an identity interface for a player to input player identity information; and, a processor for receiving player identity information and for reporting player identity information to the central management module, the processor also for receiving instructions from the central management module to allow or deny player access to the electronic gaming device and for sending instructions to the electronic gaming device to allow or deny player access to the electronic gaming device.

In yet another embodiment, the invention provides a method of retrofitting an existing gaming system having a plurality of networked gaming devices to provide responsible gaming system functionality to the networked gaming devices comprising the steps of:

connecting a player management device to a local gaming device and a central management module through a network, the player management device for receiving identity data from a player, communicating player identity and gaming data to the central management module and for controlling access to the local gaming device in response to approval by the central management module and, operatively connecting the central management module to the player management device, the central management module for receiving, storing, and processing identity data relating to individual players enrolled with the system and gaming data relating to gaming activities of the individual players using the system.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a method and system for retrofitting electronic gaming devices (EGDs) connected over a network to enable the existing gaming devices to operate as a responsible gaming system as described in Applicant's co-pending application. Within the context of the invention, the responsible gaming system is capable of tracking the gambling activity of individual gamers, and permitting or denying access to EGD units within the gaming system in accordance with preset individualized limits.

The following description describes a system utilizing VLTs with it being understood that the invention can equally apply to other EGDs.

Figure 1:
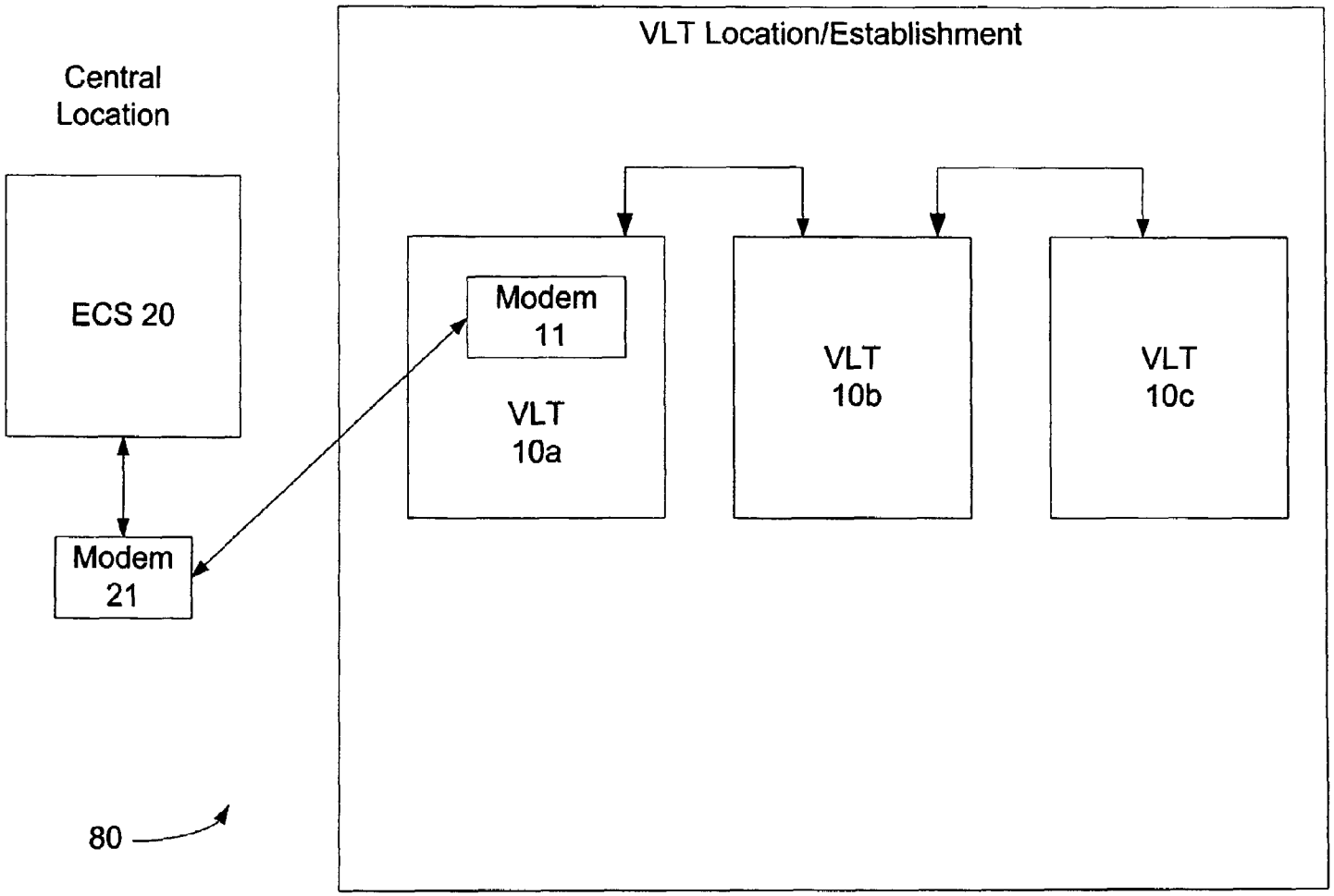
FIG. 1 is a schematic diagram of a prior art gaming configuration.

In FIG. 1, a typical gaming system 80 in accordance with the prior art is shown. In a typical installation, several standard VLT's 10*a*, 10*b*, 10*c* are connected in series in a daisy chain configuration with one of the VLT units 10*a* communicating with a central system 20 via telephone modems 11, 21. The central system 20 is responsible for monitoring the VLT units 10*a*, 10*b*, 10*c*, and the gaming system 80 includes existing hardware (not shown) and software for gaming, data collection, and control. In the typical system 80, a user may approach any VLT and anonymously begin gaming without any individualized data collection. As the VLT is used by various individuals, the central system 20 merely collects general information regarding VLT usage, total spend, and total payout, but does not collect individual-specific data. Moreover, the central system 20 cannot determine whether an individual has won or lost money over a period of time, during which they may have visited several VLT units 10.

Figure 2:
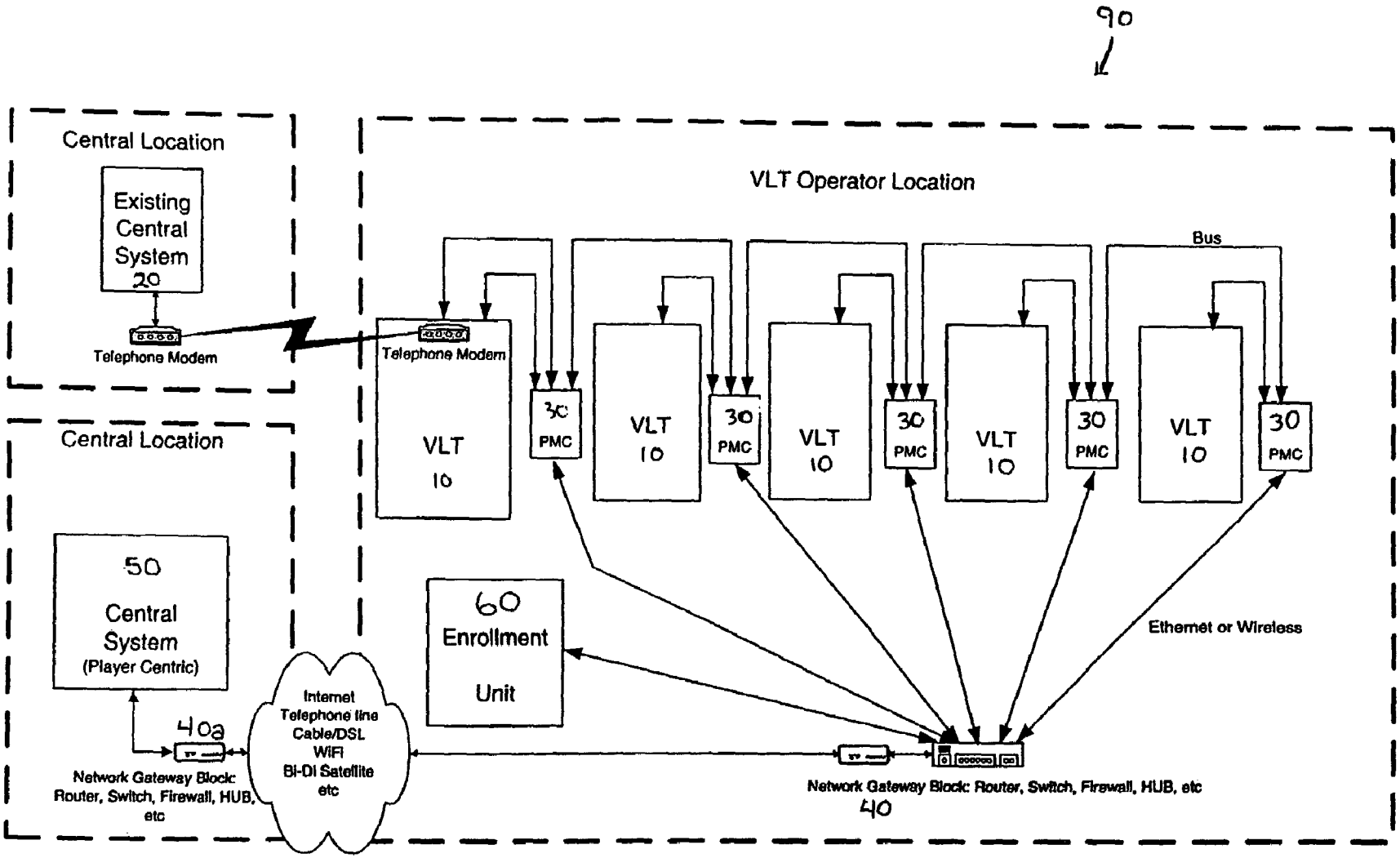
FIG. 2 is a schematic diagram as in FIG. 1 with configured player management consoles (PMCs) in accordance with one embodiment of the invention.

FIG. 2 shows a responsible gaming system 90 in accordance with one embodiment of the invention in which a typical gaming system has been retrofitted to become a responsible gaming system. Each VLT 10 remains unaltered both in appearance and gaming functionality as compared to the typical system 80 described above. However, each VLT unit 10 has been retrofitted with a player management console (PMC) 30, which must be accessed by each player prior to using the VLT and which will allow or deny access to the gaming functionality. The PMC 30 communicates with the VLT 10, through a data cable to the central system (which may include a network gateway 40 selected from but not being limited to various combinations of routers, switches, firewalls, HUBs etc.), with both the existing central system 20 and a central management module or Player Centric Central System (PCCS) 50. The PCCS 50 receives and processes data from each PMC 30.

The system also includes a player enrolment unit 60 at a number of remote locations with the primary function of enrolling new players. Enrolment units 60 may be located at each remote location or may be located at only selected locations within the system 90. The enrolment unit 60 also allows a player to set certain gaming limits, such as time spent gaming, money lost over a period of time and money won over a period of time, as detailed in Applicant's copending application. In addition, the enrolment unit may also allow an individual establishment to impose certain limits on individual players, or upon all new players. In all cases, when a player reaches an exclusion limit, access to the VLT will be denied by the PMC 30, and the player will no longer be able to operate the VLT 10 in accordance with the exclusion criteria.

In one embodiment, the PMC 30 may also allow the player to access other services within the establishment such as ordering drinks or food from a menu, book a hotel room, make dinner reservations or access various concierge services. Such services may also be halted in the event of a player reaching the exclusion criteria.

Player Enrolment

When a player enters an establishment, the player is directed to an enrolment unit 60, which may be an un-staffed kiosk or a staffed service centre. The enrolment unit may be separate to or associated with an individual PMC 30. In order to enroll, the player is required to provide proper identification in order to open a player account. Once proper identity has been established and the player is enrolled with system with a player account, the player account may only be accessed by the player, as ensured by appropriate security systems. Verification of a player's identity may be established via a number of security system including but not limited to a personal identification number (PIN), swipe card including a smart card, or an appropriate form of biometric identification, such as a retinal, voice, palm, hand, face or fingerprint scan. Such security measures also generally ensure that players cannot open multiple accounts within the responsible gaming system 90.

The player information is communicated to the PCCS 50 for storage and comparison to existing accounts to ensure that the player has not been previously enrolled in the responsible gaming system 90. If the player information is already associated with another account, the player may choose whether to continue using the existing account, or to open a new account, in which case the existing account will be terminated, with the existing account information carried forward to the new account.

When a new account is opened, the player may set certain limits and exclusions, including total expenditure, VLT expenditure, VLT loss limit, or specific gaming exclusions as described in Applicant's copending application. For example, a player may wish to prevent VLT losses of more than $200 in a 24-hour period. In this case, the account would track gains and losses, and would allow unlimited VLT gaming until such time as the player experienced a $200 net loss in a 24-hour period. Alternatively, the player may set a daily, weekly, or monthly minimum account balance or expenditure limit, which would track all money spent on their account. This may include VLT use as well as food and beverage purchases or other services, thereby terminating access once the user reaches the limit. Other limits and exclusions can be set using the enrolment unit, such as limiting access to certain VLT units to which the user believes he is most vulnerable, limiting the hours of access, or limiting the number of deposits that can be made to the account over a period of time.

In addition, the establishment or jurisdiction may impose certain limits upon the account on a global or individual basis. For example, restrictions or limits may be imposed on new accounts, or on accounts in which a player consistently reaches loss or time limits. Limits may also be set in accordance with regional legislation, if applicable.

Player Management Console (PMC) 30

Access to the PMC 30 is enabled by associating an identifier with each player account. For example, upon enrolment, a token card may be issued to the newly enrolled player, for operative engagement with a PMC 30 to provide access to the associated VLT 10. A token card may include a memory storage device, magnetic card, smart card, IC card, ibutton, proximity card, RF card, flash card, USB hard drive, key fob, memory stick, PCMCIA card, EEPROM, RAM data keys and optical storage devices such as CD-R/RW, DVD-R/RW. For the purposes of illustration within this description, the token card is a smart card. In this example, a PIN may be associated with the card to prevent unauthorized use, and the PMC 30 would include a keypad for entry of the PIN. The smart card may store account information, including funds, or may simply provide electronic recognition of the player with information retrieved from the PCCS 50. Alternatively, the identifier may be a biometric parameter such as a fingerprint, handprint face or retinal scan, voice recognition or other biometric identifier as outlined above, and the enrolment unit 60 and PMCs 30 would include an appropriate and corresponding recognition system to permit access to VLTs 10. It should be noted that in a preferred embodiment, strict rules with respect to anonymity and privacy will be implemented to ensure that neither a player's name nor any biometric information be associated with an individual using the system.

In a retrofitted establishment, each VLT 10 is associated with a PMC 30, which must be accessed by an enrolled player prior to VLT 10 use by the player. A PMC may be a standalone unit connected to the VLT by an appropriate data cable or physically attached to the VLT 10 through an appropriate connection system. A PMC may also be at least partially contained within a EGD in the event that customized EGDs are developed. In one embodiment, the PMC is a standalone unit that also forms a food or beverage stand for use while gaming at the VLT 10.

However, in order to minimize the extent of the retrofit process, it is preferred that the PMC 30 does not require a special physical attachment to the VLT 10 or a separate power source, but is connected to the existing cable connections, such as a VLT 10 serial cable, as a pass-through system in which access to the VLT 10 is permitted or restricted by the PMC 30. The PMC should not require any additional hardware or software integration into the existing VLT 10, thereby avoiding alterations to the VLT 10 which may necessitate recertification of the unit 10.

Figure 3:
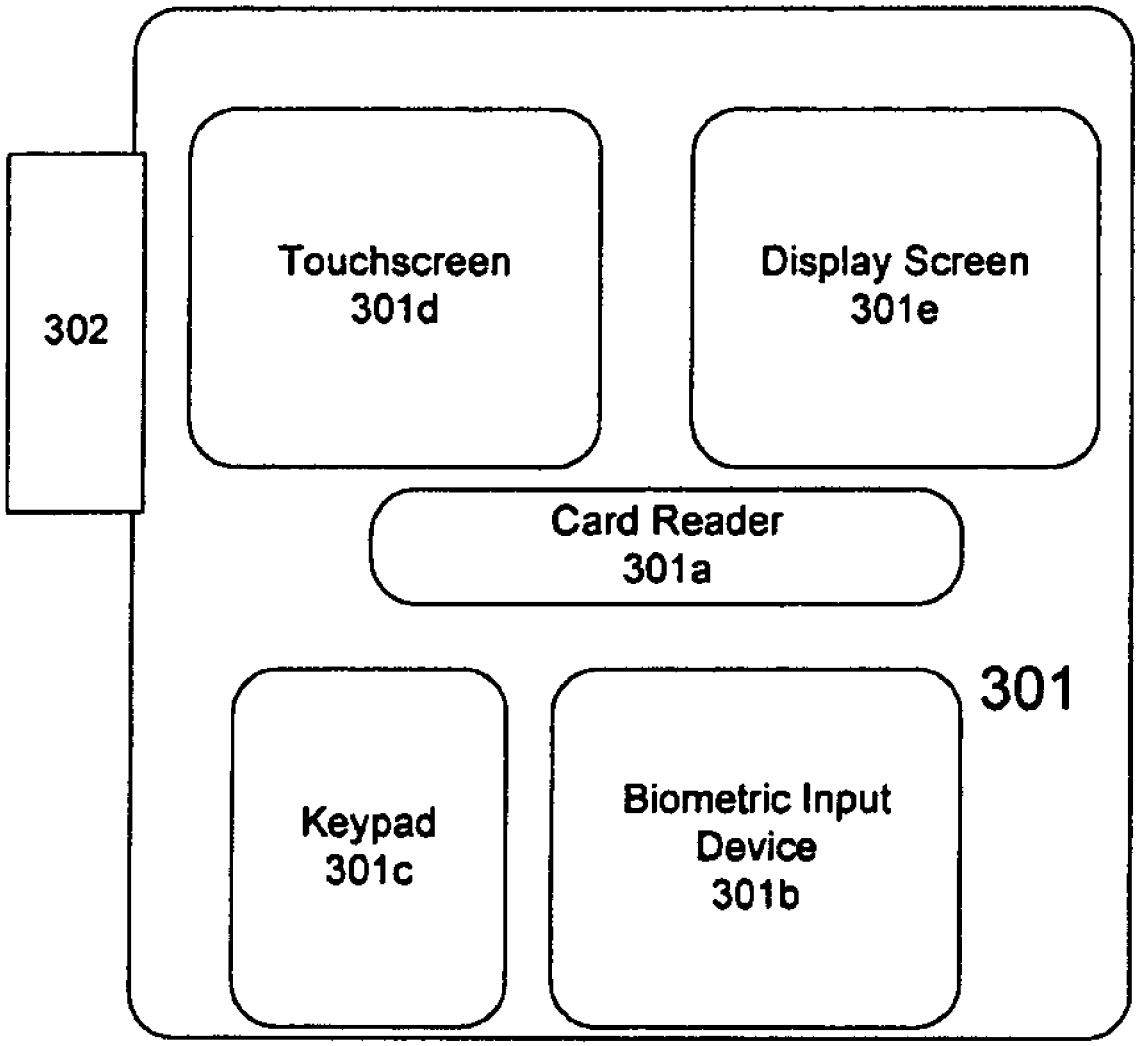
FIG. 3 is a schematic view of a player management console in accordance with one embodiment of the invention.

As shown in FIG. 3, the PMC 30 includes an identification system 301 and a connection port 302 for connection to a VLT 10. As noted above, the identification system 301 may be a token card reader 301*a*, a biometric input device 301*b* such as a fingerprint scanner, face, hand, retinal scanner, or voice recognition device, and may also include a secondary identification or input device such as a number keypad 301*c* or touchscreen 301*d*. A display screen 301*e* may also be included. When an enrolled player is identified by the PMC, the PMC will either permit or deny access to the associated VLT 10 based on the account status of the player.

The Responsible Gaming System (RGS) determines the account status by comparing the preset limits and exclusions to the actual play history of the enrolled player. Either a processor within the PMC will make this comparison using stored information or information requested from the PCCS, or the comparison will be requested by the PMC, carried out by the Player Centric Central System (PCCS), with the permit/deny outcome returned to the PMC 30.

Therefore, the PMC 30 may form a mini-central system by requesting, storing, and processing information to monitor and control the VLT using some features of the central system protocol (VLC POLL2, SAS, Mikohn, etc), thereby creating triggers for the responsible gaming features. In this embodiment, the PMC operates without destroying or altering the data flow to and from the existing central system 20. Furthermore, and as noted above, it is preferred that the PMC has pass-through functionality so as to not interfere with a jurisdiction's normal data collection and control by the existing central system 20.

Existing Central System (ECS) 20 and Player Centric Central System (PCCS) 50

The existing central system 20, as currently present in jurisdictions and establishments containing standard or existing VLT's 10, collects, stores, and processes information relating to each VLT 10, and to the jurisdiction as a whole. Such information may include VLT usage time, money collected, money expended as winnings, machine errors, VLT program cycles, popular machines and machine locations. As noted, the ECS 20 does not collect player centric data.

The PCCS 50 is added to the existing gaming system 80 in order to convert the existing gaming system 80 to a responsible gaming system 90. The PCCS 50 is connected to a network through an appropriate network connection 40*a*. The network may be any known network such as internet, DSL, cable broadband, ISDN, bi-directional satellite, connected telephone line, or cellular GPRS, and the network is, in turn, connected to each PMC 30. In a preferred embodiment, the PCCS 50 connection to the network gateway is redundant such that if the primary communication means to the PCCS 50 fails, automatic conversion to a secondary communication means occurs to maintain the integrity of the responsible gaming system 90.

The PCCS collects and stores gaming information and gaming history as well as personal account information and personal identification information. For example, the player data collected by the PCCS 50 may include biometric information (preferably coded biometric information), account activity and status, preset limits and exclusions, total money spent by the user, total time spent gambling, number of failed and successful login attempts over a period of time, such that if a smart card identification is lost, the smart card can be inactivated, and a new card supplied to the enrolled player. Moreover, the PCCS 50 ensures that a player account is not being utilized at separate locations simultaneously.

The PCCS 50 may also collect information on behalf of the establishment, including favorite VLT units 10, favorite times of day to game, number of players gaming, machine inactivity, errors, and machine security features.

The PCCS may be located offsite, and may be connected to various gambling establishments, monitoring player activity at several locations, and potentially over several cities.

Self-Serve Kiosk

Figure 4:
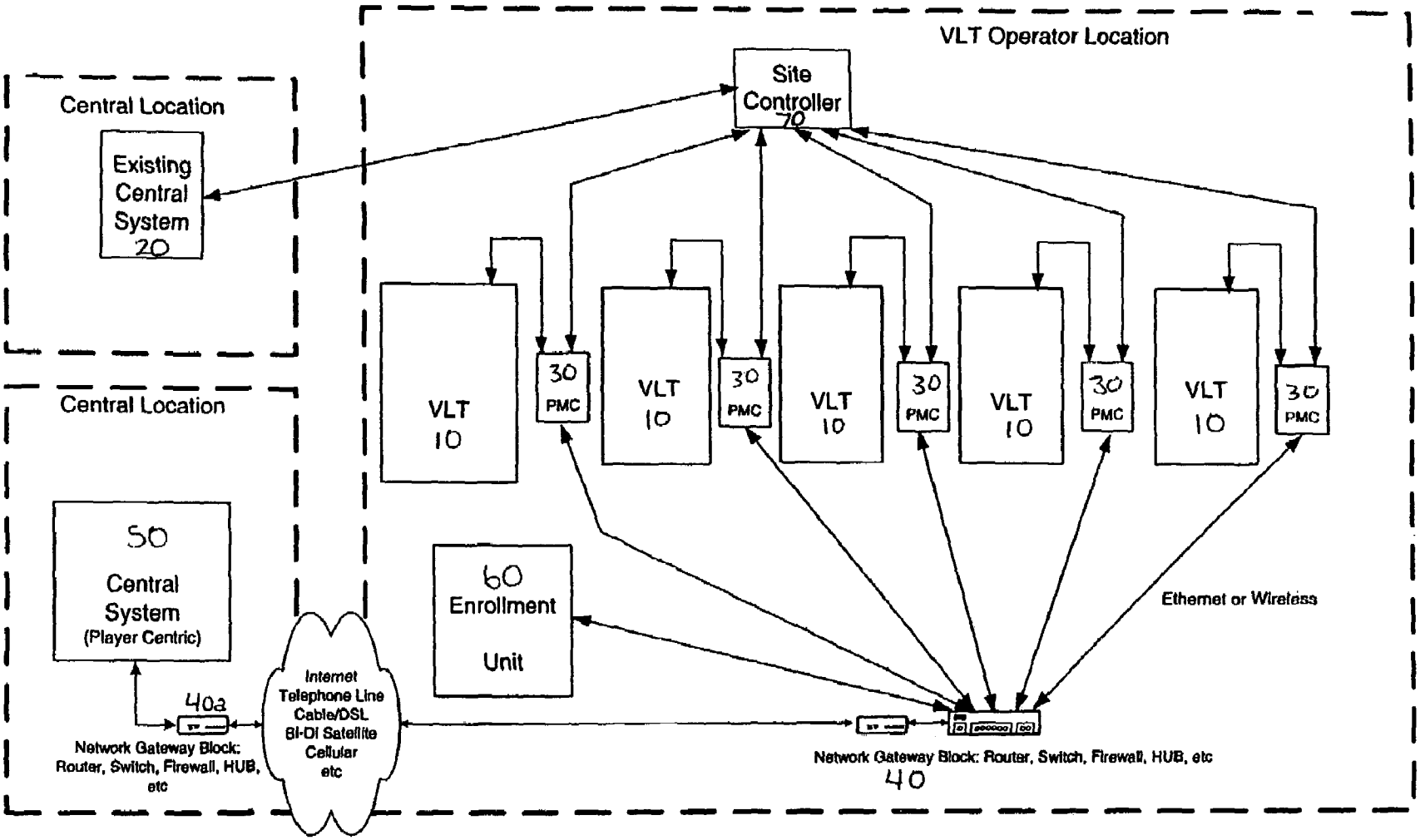
FIG. 4 is a schematic diagram showing a retrofitted responsible gaming system with a self serve kiosk connected in a star configuration.
Figure 5:
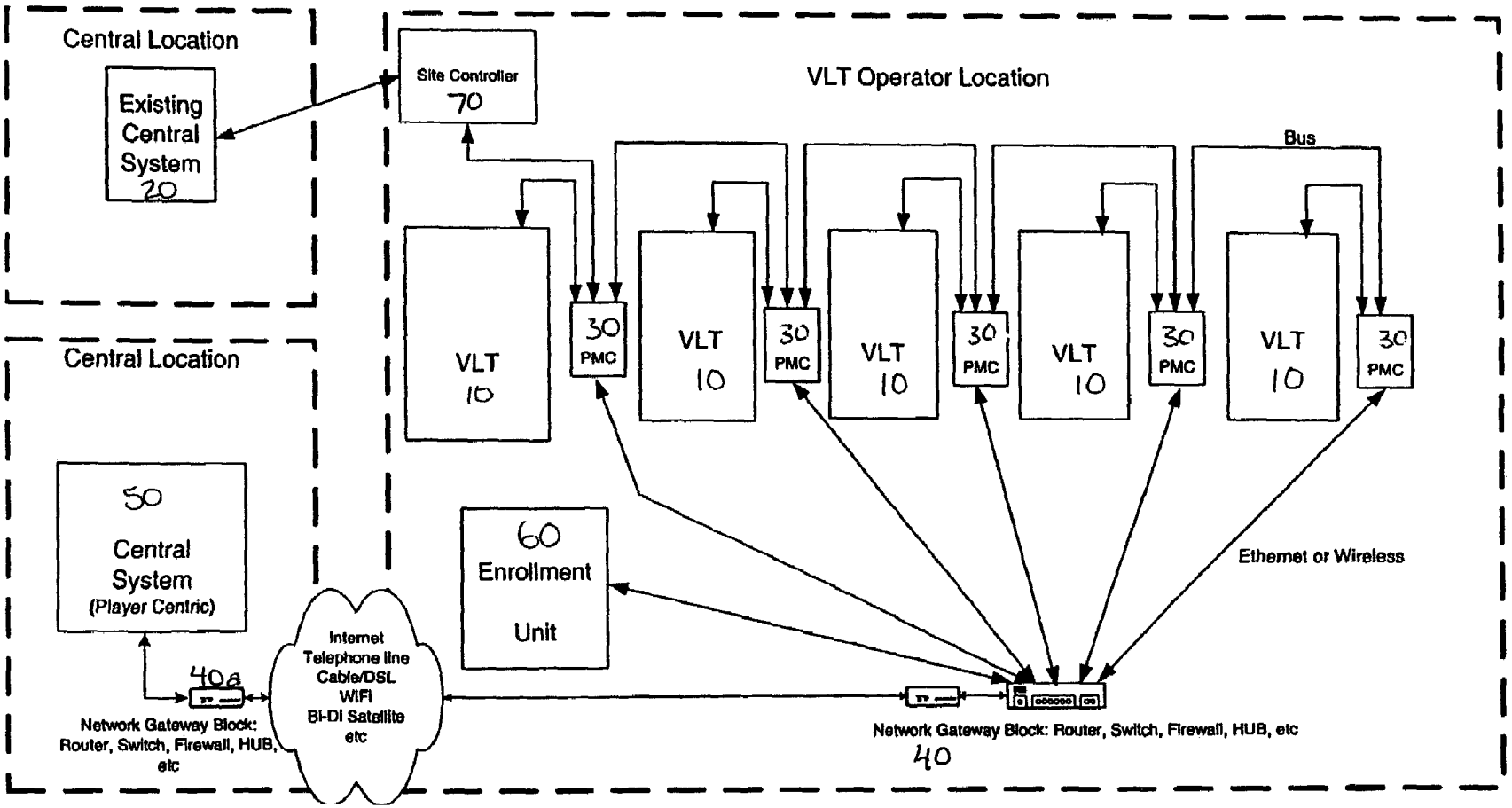
FIG. 5 is a schematic diagram showing a retrofitted responsible gaming system in with a self serve kiosk connected to a Site Controller.

In one embodiment, as shown in FIGS. 4 and 5, the system also provides a site controller or self-serve kiosk 70 configured to the system in a star (FIG. 4) or bus configuration (FIG. 5). The self-serve kiosk 70 may permit enrolled users to access their accounts and print various reports and summaries based on the information stored within the PCCS 50. The kiosk 70 preferably includes a display and may be interactive, allowing the user to withdraw money, load money into their account electronically, dispense winnings or display account balances.

The self serve kiosk 70 may be combined with the enrolment unit 60, and may also permit users to make changes to their personal account limits and exclusions.

Other System Features

The responsible gaming system may also enable an establishment to customize the services available to users of the system. For example, the system may allow a game to be saved until their next visit or access various establishment services. The enrolment unit 60, PMC 30, or self serve kiosk 70 may display advertising on a touch screen, may provide an orientation, education, awareness or training program, or may permit the establishment to conduct player surveys. Other possible functions or options will be customizable at the request of each individual establishment. In one embodiment, a player's preferences may be stored on the system to provide a customized display to a player.

In one embodiment, some PCCS functionality is provided at the token level wherein a player's account information including account funds and exclusion limits are stored on the player's token. In this embodiment, tokens having sufficient memory and/or processing capabilities are required. Information on a token is periodically reported to the PCCS so as to reduce the level of real-time communication between a PMC and the PCCS.

Use of the System

Figure 6:
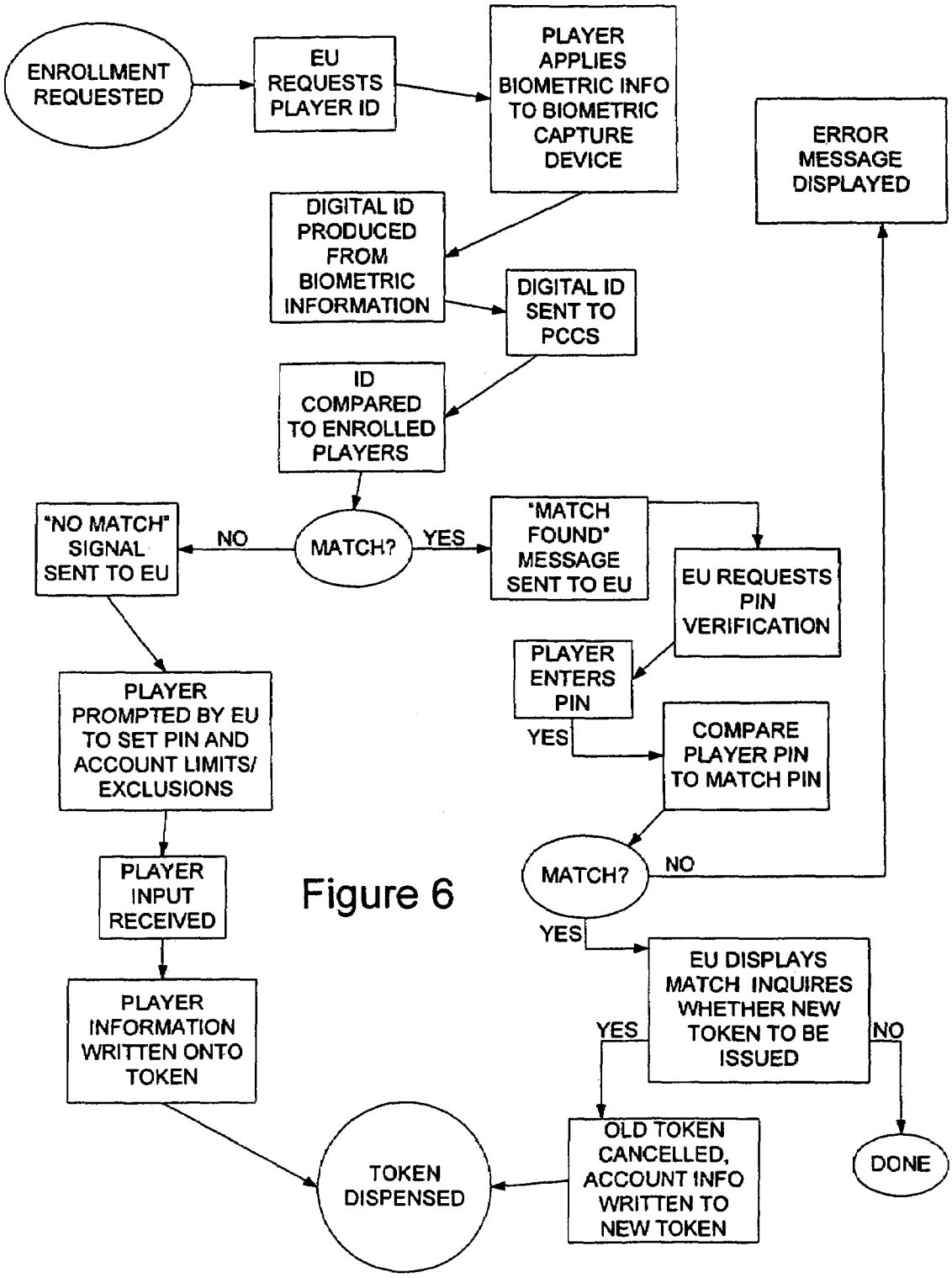
FIG. 6 is a schematic diagram depicting an embodiment of the enrolment process

As shown in FIG. 6, a preferred registration process is described. A potential player approaches the enrolment unit and is prompted to identify themselves by providing biometric information to a biometric capture device. The information is received by the enrolment unit and converted to a coded digital identity. The digital identity is transmitted to the PCCS 50 where it is compared to the coded digital identities of all previously enrolled players. If the digital identity does not match any previously enrolled player, a "no match" signal is returned to the enrolment unit 60. The player will then be prompted by the enrolment unit to select a PIN number to associate with the new account. The player will then be prompted by the enrolment unit to enter any desired gambling limits or exclusions in addition to the limits applied automatically by the system. Upon successful enrolment, the newly enrolled player will receive a token card containing the player's account information or a coded number to identify the player account on the central system.

When a previously enrolled player applies their biometric information to the biometric capture device, the enrolment unit will read the print and convert it to a digital identity. When the digital ID is sent to the PCCS for comparison, a "match found" signal will be sent to the enrolment unit, which will display a "match found" message on the display screen. The enrolment unit will then request that the player identify their personal identification number (PIN) for verification of the matching identity. The player will enter a PIN via the touchscreen or keypad, and the PIN will be compared to the PIN number associated with the matching identity. If the PINs do not match after a pre-determined number of tries, the enrolment unit will deny further access by the player.

If the PINs match, then the player will be notified that a matching account has been located and the player may elect to have a new token issued, in which case the old token will be inactivated.

Figure 7:
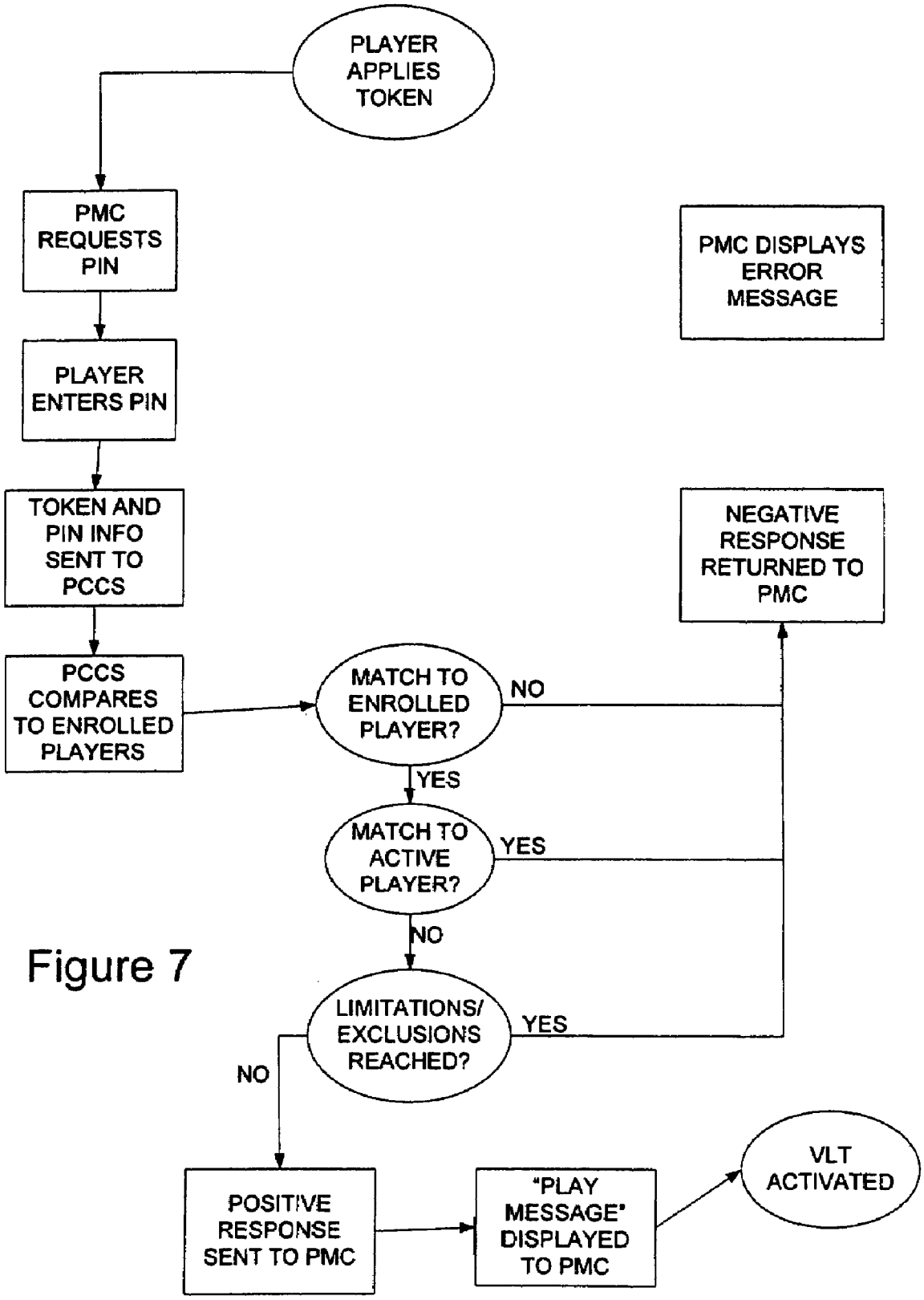
FIG. 7 is a schematic diagram depicting an embodiment of the PMC access process; and, FIG. 8 is a schematic diagram depicting an embodiment of the play monitoring process.

As shown in FIG. 7, when an enrolled player desires to use a VLT 10, the player approaches a PMC and identifies themselves to the PMC using biometric information or by a token. The PMC 30, upon activation by a token, will read the identity information from the token and send the information to the PCCS 50 to identify the player. The player will also be required to enter a PIN or biometric information to validate their identity. This information is sent to the PCCS, where it is compared to the identities of all enrolled players. If a match is not found, a negative response is sent to the PMC, an error message is displayed to the player, and the PMC is reset. If a positive match is found, the PCCS will determine whether that player is already actively gaming elsewhere in the system to prevent duplicate use of the player account. If the player is currently inactive, the PCCS will determine whether the player's gambling limits or time-based exclusions have been reached. If the player meets the limitation or exclusion criteria, then the PMC will display an error message and access will be denied. If the player does not meet limitation or exclusion criteria, a positive response is sent to the PMC, which displays a "play" message and activates the VLT.

Figure 8:
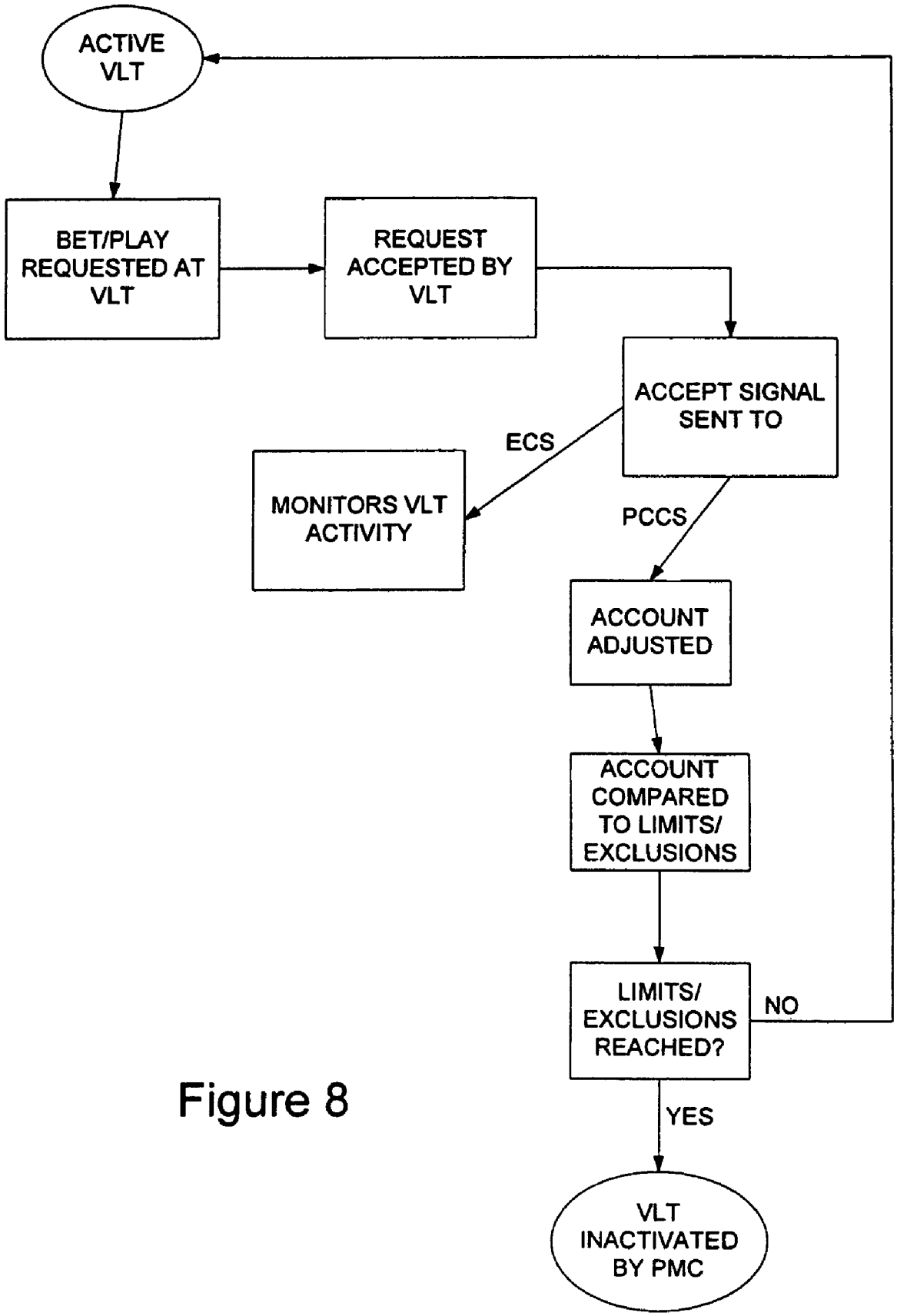

During gaming at the activated VLT, the RGS is constantly monitoring the players gaming according to the process shown in FIG. 8. When the VLT is active, the player can make a bet or play using the VLT, and the play request is accepted by the active VLT. Upon accepting and carrying out a play request, information is sent to the existing control system 20 for monitoring of VLT activity, usage, errors, and income/payout. Simultaneously, information is also sent through the PMC to the network gateway and to the PCCS to adjust the player's account. The PCCS then compares the player's account to the preset limitations and exclusions to determine whether these limitations and exclusions have been reached. If so, then the PMC will deactivate the VLT. Otherwise, the player may continue to game, with the player's account being constantly updated. Optionally, the token may remain in the PMC, being updated in real-time while gaming occurs.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A responsible gaming system enabling networked gaming devices to be retrofit to operate as a responsible gaming system in order to allow or deny player access to a local gaming device on a gaming network in accordance with player exclusion criteria, the networked gaming devices having an existing central system for managing the networked gaming devices that remains unmodified after being retrofit with the responsible gaming system, the responsible gaming system comprising:

a central management module for, independently of the existing central system, receiving, storing, and processing identity data relating to individual players enrolled with the systems, gaming data relating to gaming activities of the individual players using the system and player account information, the central management module being retro-fit to the networked gaming devices without affecting data collection functions of the existing central system; and, a player management console for operative and retro-fit connection to a local gaming device by a flow through data connection and the central management module, the player management console including an input device for receiving identity data from a player, and communicating player identity data to the central management module only; the player management console also for communicating gaming data to the central management module and for controlling access to the local gaming device in response to approval by the central management module; the player management console further including a display for providing a player with player account information received from the central management module;

wherein the central management module provides instructions to the player management console to enable activation or cause de-activation of a local gaming device in accordance with pre-determined player exclusion criteria; and wherein the existing central system remains unmodified after being retrofit with the responsible gaming system.

2. A system as in claim 1 wherein the pre-determined exclusion criteria include any one of or a combination of time spent gaming, money lost over a period of time, money won over a period of time, total hours of access over a period of time, time of day hours of access, and account deposit limits over a period of time.

3. A system as in claim 1 wherein the player management console includes a communication port for operative connection to a local gaming device through a flow-through communication port wherein the flow-through communication port enables previously existing data collection functions to pass between the gaming device and the existing central system through the player management console.

4. A system as in claim 1 wherein the player management console includes an input system enabling a player to enter pre-determined exclusion criteria into the system.

5. A system as in claim 1 further comprising at least one enrollment device operatively connected to the central management module wherein the enrollment device includes an identity input system for inputting player identity information to the system for establishing a player account with the central management module only and not with the existing central system.

6. A system as in claim 5 wherein the enrolment device includes an enrolment input system enabling a player to enter pre-determined exclusion criteria into the central management module for evaluation and monitoring by the central management module.

7. A system as in claim 5 wherein the identity input system includes a biometric input system for providing player identity data to the central management module only.

8. A system as in claim 5 wherein the enrolment device downloads player identity information to a player token selected from any one of or a combination of a magnetic swipe card, smart card, IC card, ibutton, proximity card, RF card, flash card, USB hard drive, key fob, memory stick, PCMCIA card, EEPROM, RAM data keys and optical storage devices including CD-R/RW and DVD-R/RW.

9. A system as in claim 5 wherein the player management console includes a token reading device for operatively receiving player identity information from a player token.

10. A system as in claim 9 wherein the player management console includes a biometric capture device for receiving biometric information from a player for use as player identity information for the central management module only.

11. A system as in claim 10 wherein the player management console reports biometric information to the central management module only and the central management module evaluates the uniqueness of the biometric information within the system.

12. A system as in claim 4 wherein the player management console is operatively connected to an establishment computer and the input system enables a player to access beverage and food services from the player management device.

13. A system as in claim 8 wherein a player's account fund information and exclusion limits are stored on a player token.

14. A player management console (PMC) for controlling player access to an electronic gaming device connected to an existing central system, the PMC comprising:

a first communication port for operative attachment to an electronic gaming device and the existing central system by a flow through data connection;

an identity interface for a player to input player identity information; and, a processor for receiving player identity information and for reporting player identity information to a central management module only through a second communication port, the central management module enabled to provide responsible gaming functionality to the player management console, the processor also for receiving instructions from the central management module to allow or deny player access to the electronic gaming device and for sending instructions to the electronic gaming device to allow or deny player access to the electronic gaming device wherein the PMC does not interfere with data flow to and from the existing central system;

the PMC further including a display for providing a player with player account information received from the central management module.

15. A responsible gaming system as in claim 1 wherein the central management module is a physically distinct server from the existing central system.

16. A PMC as in claim 14 further comprising a body having an integral beverage stand.

17. A method of retrofitting an existing gaming system having a plurality of networked gaming devices connected to an existing central system to provide responsible gaming system functionality to the networked gaming devices such that the existing central system remains unmodified after being retrofit with the responsible gaming system, comprising the steps of:

connecting a player management console by a flow through data connection to a local gaming device and a central management module through a network, the player management console for receiving identity data from a player, communicating player identity data and gaming data to the central management module only and for controlling access to the local gaming device in response to approval by the central management module and, operatively connecting the central management module to the player management console, the central management module for receiving, storing, and processing identity data relating to individual players enrolled with the system and gaming data relating to gaming activities of the individual players enrolled with the system and gaming data relating to gaming activities of the individual players using the system wherein the player management console does not interfere with data flow to and from the existing central system.

18. A responsible gaming system as in claim 1 wherein the player identity data relating to individual players enrolled with the system is provided to the central management module only and not to the existing central system.

* * * * *